United States Patent [19]

Robinson

[11] Patent Number: 4,777,604

[45] **Date of Patent: * Oct. 11, 1988**

[54] METHOD AND APPARATUS FOR CONTROLLING BATCH DRYERS

[76] Inventor: John W. Robinson, 108 Cypress St., Silsbee, Tex. 77656

[ * ] Notice: The portion of the term of this patent subsequent to Oct. 22, 2004 has been disclaimed.

[21] Appl. No.: 92,635

[22] Filed: Sep. 3, 1987

Related U.S. Application Data

[63] Continuation-in-part of Ser. No. 573,696, Jan. 25, 1984, Pat. No. 4,701,857.

[51] Int. Cl.[4] ..... F26B 21/10; F26B 21/12

[52] U.S. Cl. ..... 364/477; 364/471; 34/28; 34/46; 34/48; 34/52

[58] Field of Search ..... 364/471, 477, 468, 557; 34/9.5, 26, 28, 41, 43, 48, 52, 25, 46

[56] References Cited

U.S. PATENT DOCUMENTS

| | | | |
|---|---|---|---|
| 3,807,055 | 4/1974 | Kraxberger | 34/46 X |
| 3,961,425 | 6/1976 | Swanson et al. | 34/52 |
| 4,038,531 | 7/1977 | Loe, Jr. | 364/418 |
| 4,095,645 | 6/1978 | Massey | 364/477 |
| 4,199,871 | 4/1980 | Ward et al. | 34/25 |
| 4,206,552 | 6/1980 | Promerantz et al. | 364/477 |
| 4,255,869 | 3/1981 | Quester et al. | 34/25 |
| 4,314,878 | 2/1982 | Lee | 364/471 |
| 4,336,660 | 6/1982 | Strydom | 34/52 X |
| 4,356,641 | 11/1982 | Rosenau | 34/48 X |
| 4,373,364 | 2/1983 | Tanimoto et al. | 364/477 |
| 4,434,563 | 3/1984 | Graalmann et al. | 34/46 X |
| 4,494,315 | 1/1985 | Roos et al. | 34/52 X |
| 4,501,552 | 2/1982 | Wakamiya | 364/477 X |
| 4,513,759 | 4/1985 | Wochnowski et al. | 34/46 X |
| 4,555,854 | 12/1985 | Hegedus et al. | 34/48 X |

OTHER PUBLICATIONS

A New Idea for Control of Softwood Kilns; Eugene Wengert; Brooks Forest Products Center; Virginia Tech., Blacksburg, VA.

How Kiln Schedules Alter Lumber Strength; Gene Wengert; *Timber Processing;* pp. 40–42; Apr, 1987.

*Primary Examiner*—Jerry Smith

*Assistant Examiner*—Allen MacDonald

*Attorney, Agent, or Firm*—Vaden, Eickenroht, Thompson & Boulware

[57] ABSTRACT

A method of and apparatus for controlling dryers for wood products is disclosed by measuring a temperature differential that relates to the difference between the temperature of the drying medium before and after contact with the product as the product is being dried to determine what the final moisture content will be and controlling the differential temperature to obtain the desired moisture content in the product leaving the dryer or predicting the drying time required to dry to target final moisture content.

10 Claims, 4 Drawing Sheets

FIG. 4
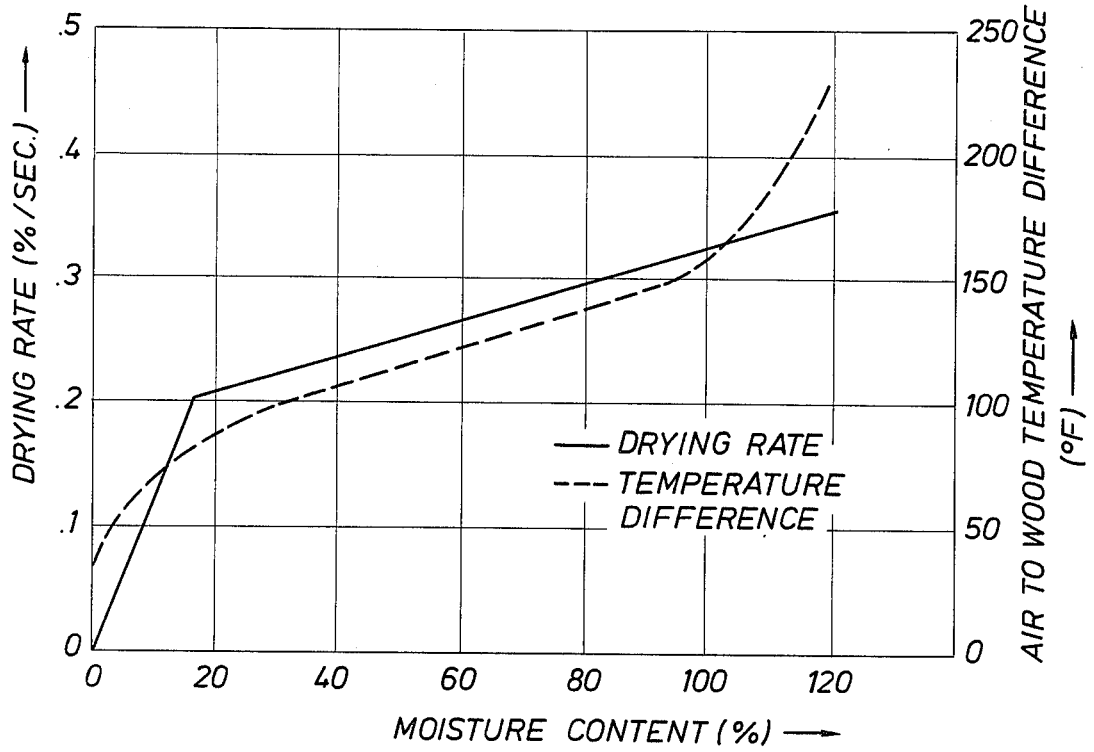
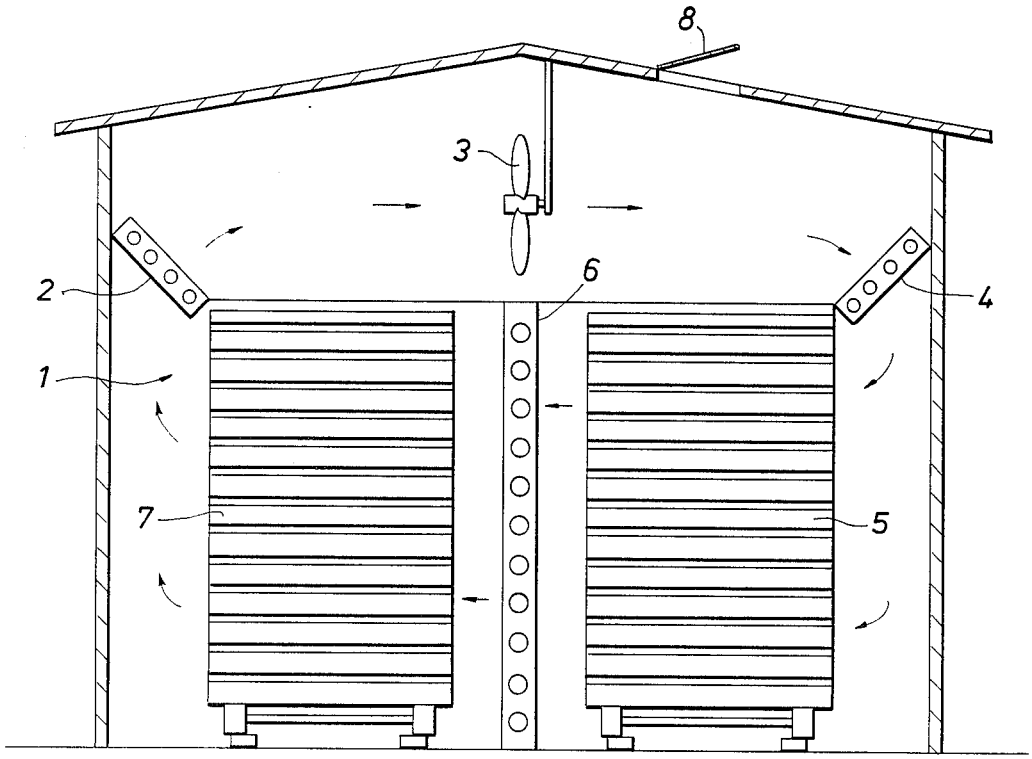
FIG. 9

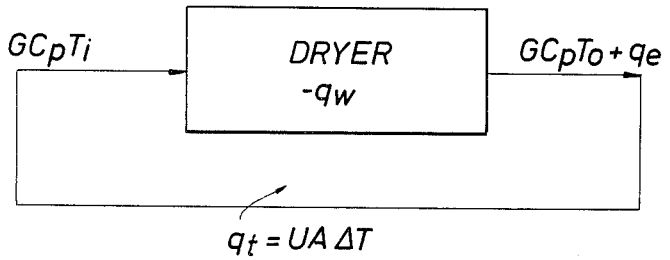
FIG. 7
FIG. 8
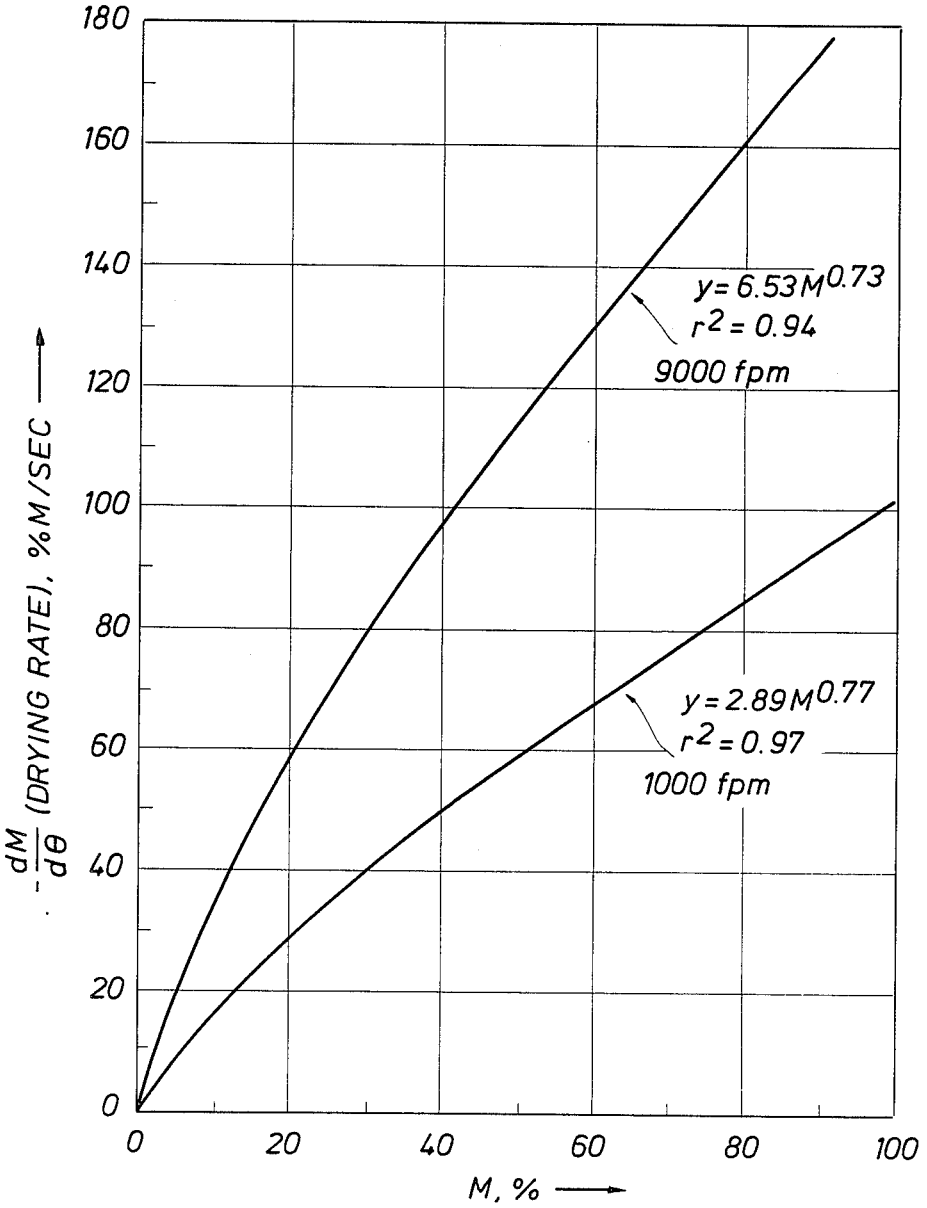

METHOD AND APPARATUS FOR CONTROLLING BATCH DRYERS

This application is a continuation-in-part of copending application Ser. No. 573,696, filed Jan. 25, 1984, and entitled Method and Apparatus for Controlling Dryers for Wood Products, Fabrics, Paper and Pulp now U.S. Pat. No. 4,701,857.

This invention relates to a method of and apparatus for controlling the operation of batch dryers for wood, fabrics, paper, pulp, fiberboards, food, chemicals, agricultural products and the like.

In most drying operations, the product being dried is contacted by a drying medium. In the case of wood, pulp, and fabrics, it is usually heated air. The variables that affect the moisture content of the dried product and that are usually monitored are: the wet and dry bulb temperatures of the heated air, the time the product is in the dryer, and the energy input.

Due to inherent variability of wood properties that affect drying rate and also the significant variation in initial moisture content of such products as lumber, veneer, fiberboard, etc., the distribution of the moisture content of the wood leaving the dryer resembles a bell-shape curve as shown in FIG. 1.

As a result, some of the wood will be overdried and some underdried thus causing quality problems. The usual practice is to try and get a large percentage of the wood in an acceptable moisture range with a minimum of overdried and underdried wood.

For example, when drying lumber, it is difficult to monitor the true moisture content of the wood in the kiln. Common practice is for the operator of the dryer to control its operation based on stopping the circulating fans, going inside and sampling for moisture content. Often, not even this is done but instead a standard drying time is established for a particular lumber dimension and species. The inevitable result is a built-in percentage of overdried and undedried wood. This is a very crude method of control.

There is a need for a dryer control system that does not require the measurement or knowledge of such properties as initial moisture content, wood species, wood specific gravity, thickness, percentage of heart or sap wood, etc. and that will continuously and effectively monitor drying as it progresses without the use of unreliable electronic moisture meters installed inside the kiln on a small sample of wood.

It is the object of this invention to provide such a system.

It is another object of this invention to provide a method of and apparatus for controlling the operation of a dryer by monitoring temperatures that can be readily measured in the dryer and using the difference between these temperatures to accurately predict what the moisture content of the product will be at all times. This allows the operation of the dryer to be adjusted while the product is being dried to produce the desired final moisture content with a minimum of underdried or overdried product.

It is a further object of this invention to provide a method of and apparatus for controlling the operation of a dryer by measuring a temperature drop in the dryer that relates to the difference between the temperature of the drying medium and that of the product being dried to determine what the final moisture content of the product will be and adjusting the temperature difference by changing the heat input or the time the product stays in the dryer or both to obtain the desired final moisture content in the product.

It is a further object of this invention to provide a method of and apparatus for controlling the operation of a dryer in which the drying medium is hot air and the difference between the temperature of the air before it contacts the product and the temperature of the air after it has contacted the product is used to determine what will be the final moisture content of the product.

These and other objects, advantages, and features of this invention will be apparent to those skilled in the art from a consideration of this specification including the attached drawings and appended claims.

In the drawings,

FIG. 4 shows the relationship of the drying rate and air to wood temperature gradient to moisture content with the solid line representing the drying rate and the dashed lines representing air to wood temperature gradient for Douglas Fir, air temperature 400° F. and air velocity 5,000 fpm; (after Comstock)

FIG. 7 shows an energy balance for a typical dryer section;

FIG. 8 is a graph of Drying Rate vs Moisture Content for 4/4 (1" nominal) Silver Maple constructed from data after Rosen.

FIG. 9 is a sketch of a Lumber Dry Kiln illustrating a batch dryer for wood.

Figure 1:
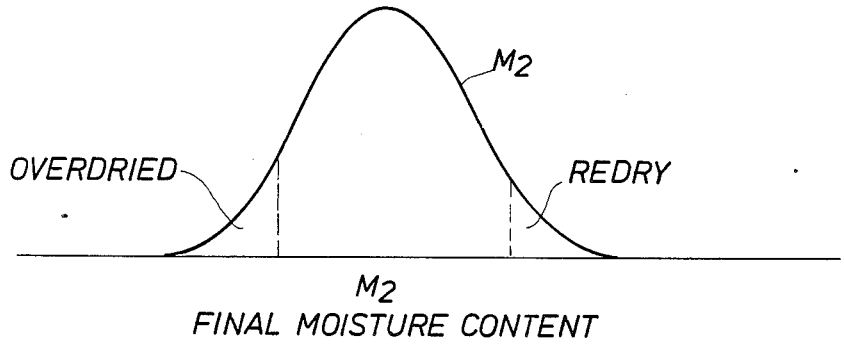
FIG. 1 is a graph of the typical variation in the moisture content of wood products leaving a dryer.

Batch dryers operate as follows: Circulating air at temperature $T_1$ in the area designated 1 enters steam coil 2 where it is heated. The heated air is moved by fan 3 through steam coils 4 where it is further heated to temperature $T_2$. The air then moves through wood stack 5 where the temperature drops to $T_3$. The air is reheated by steam coil 6 to temperature $T_4$ before it passes through wood stack 7 where the temperature drops to $T_1$. Periodically, a small amount of gas is vented through vent 8.

A significant amount of research has been done on wood drying, both for veneer and lumber. For example see:

Rosen, H. N. "Evaluation of Drying Times, Drying Rates, and Evaporative Fluxes when Drying Wood with Impinging Jets", 1st International Symposium on Drying, pp. 192–200, *Science Press*, Princeton, N.J. Aug. 3–5, 1978.

Townsend, I. K., "Moisture Content Variability in an Industrial Dry Kiln", Proc. North American Wood Drying Symposium", Miss. State Univ., Miss. State, Miss., pp. 46–48, Nov. 27–28, 1984.

Wengert, E. M. and Oliveira, L. C., "High Temperature Drying of Southern Pine—Some Theoretical Aspects Toward Better Process Control", Proc. North American Wood Drying Symposium, Miss. State University, Miss. State, Miss., pp. 49–53, Nov. 27–28, 1984.

Rosen, H. N. and Bodkin, R. E., "Development of a Schedule for Jet-Drying Yellow Poplar", *Forest Products Journal*, Vol. 31, No. 3, pp. 39–44.

Bachrich, J. L., "Dry Kiln Handbook", H. A. Simons, Vancouver, B.C., Canada.

Koch, P., "Utilization of the Southern Pines", Vol. 2, U.S. Dept. of Agriculture Handbook No. 420, 1972.

Kotok, E. S. et al, "Surface Temperature as an Indicator of Wood Moisture Content During Drying", *Forest Products Journal*, Vol. 19, No. 9, pp. 80–82, 1969.

Bethel, J. S. and R. J. Hadar. 1952. "Hardwood Veneer Drying", *Journal of the Forest Products Research Society*, Dec. 1952, pp 205–215.

Fleischer, H. O. 1953. "Drying Rates of Thin Sections of Wood at High Temperatures." Yale University: School of Forestry Bulletin, No. 59. p. 86.

Comstock, G. L. 1971. "The Kinetics of Veneer Jet Drying", *Journal of the Forest Products Research Society*, Vol. 21, No. 9. pp 104–110.

South, Veeder III. 1968. "Heat and Mass Transfer Rates Associated with the Drying of Southern Pine and Douglas Fir Veneer in Air and in Steam at Various Temperatures and Angles of Impingement." M. S. Thesis. Oregon State University. p. 61.

Figure 2:
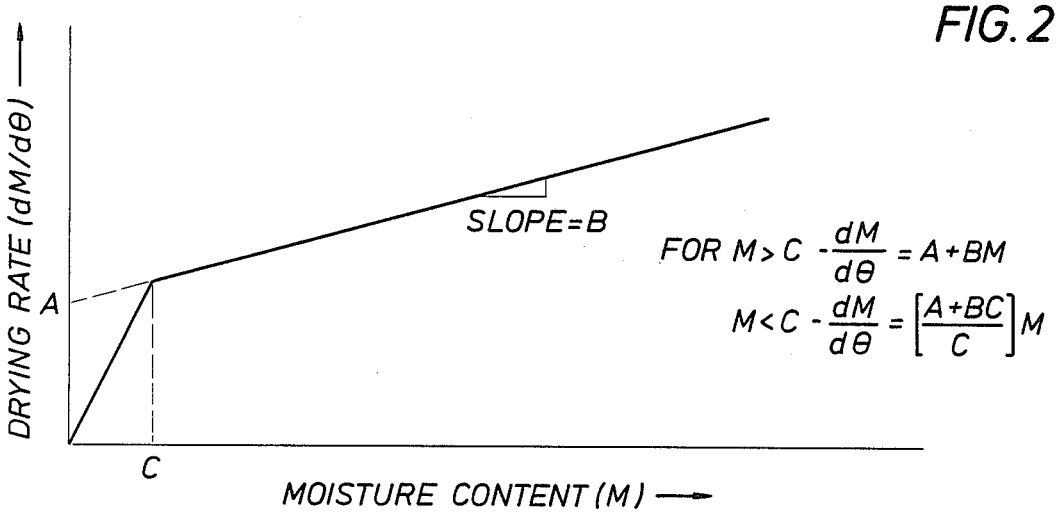
FIG. 2 is a graph of the straight line relationship between moisture content (M) and drying rate ($dM/d\theta$) previously believed to be valid; (after Comstock)
Figure 3:
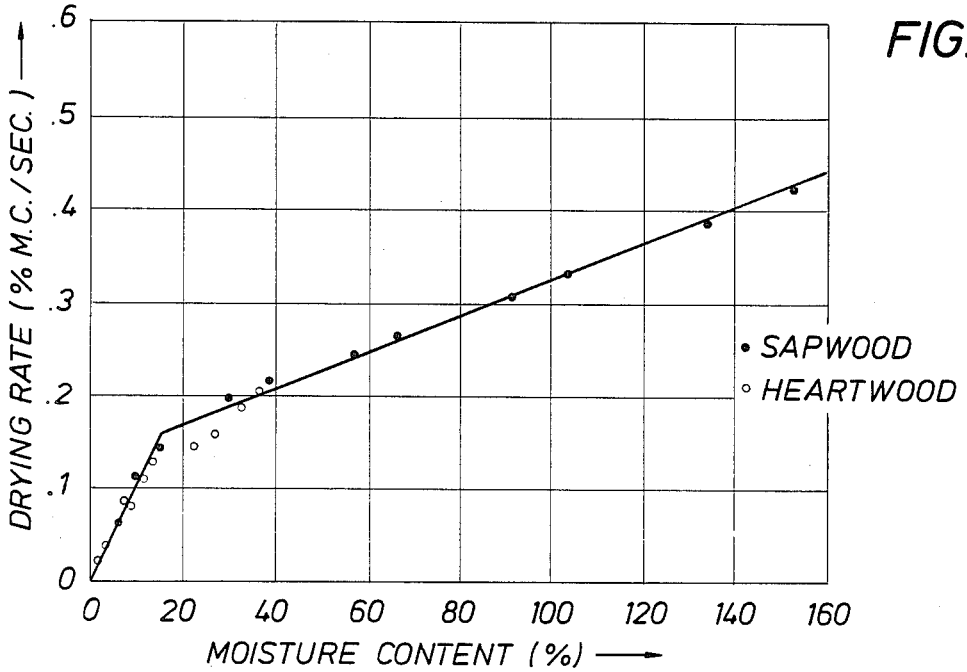
FIG. 3 is a drying rate curve for Douglas Fir heartwood and sapwood samples, air temperature 300° F. and air velocity 5,000 fpm; (after Comstock)

Most of the previous work is based on a straight line relationship between drying rate, ($dM/d\theta$), and moisture content, M. Comstock (op cit), for example developed two equations for ($dM/d\theta$). One for when M is greater than C and one for when M is less than C. The curves for both equations are straight lines that intersect at C, as shown in FIG. 2.

Figure 6:
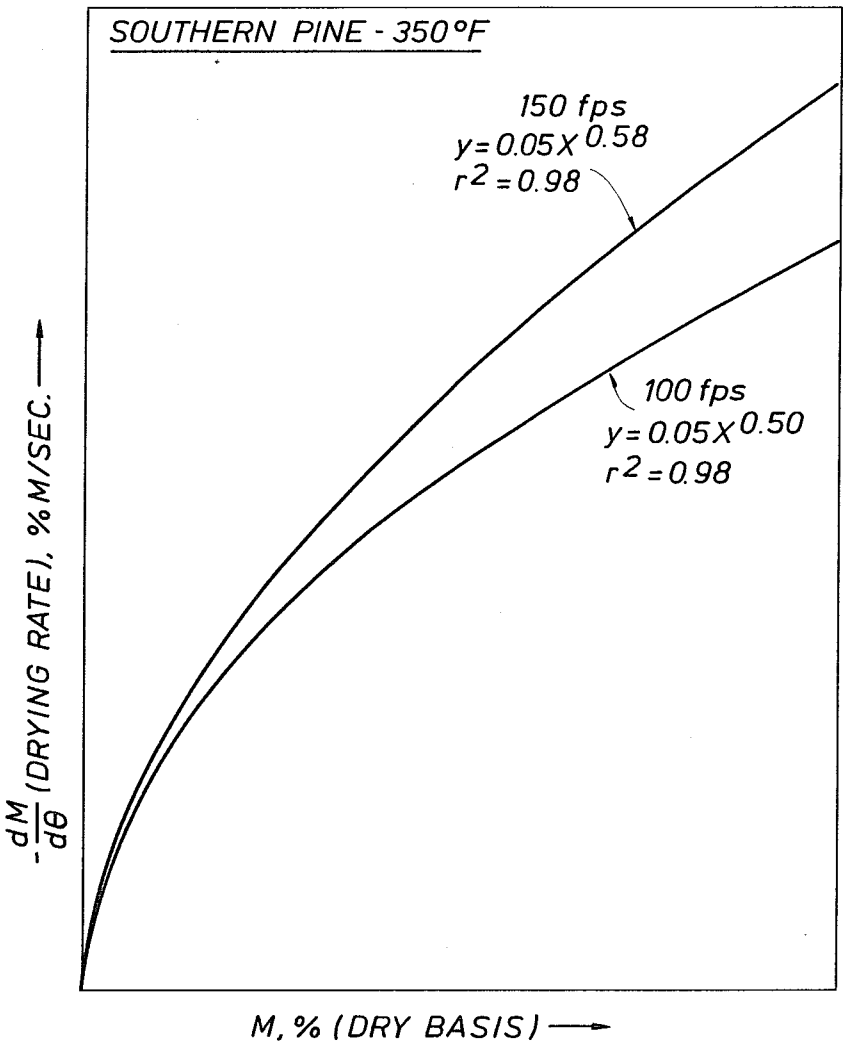
FIG. 6 is a graph similar to FIG. 2 for Southern Pine.
Figure 5:
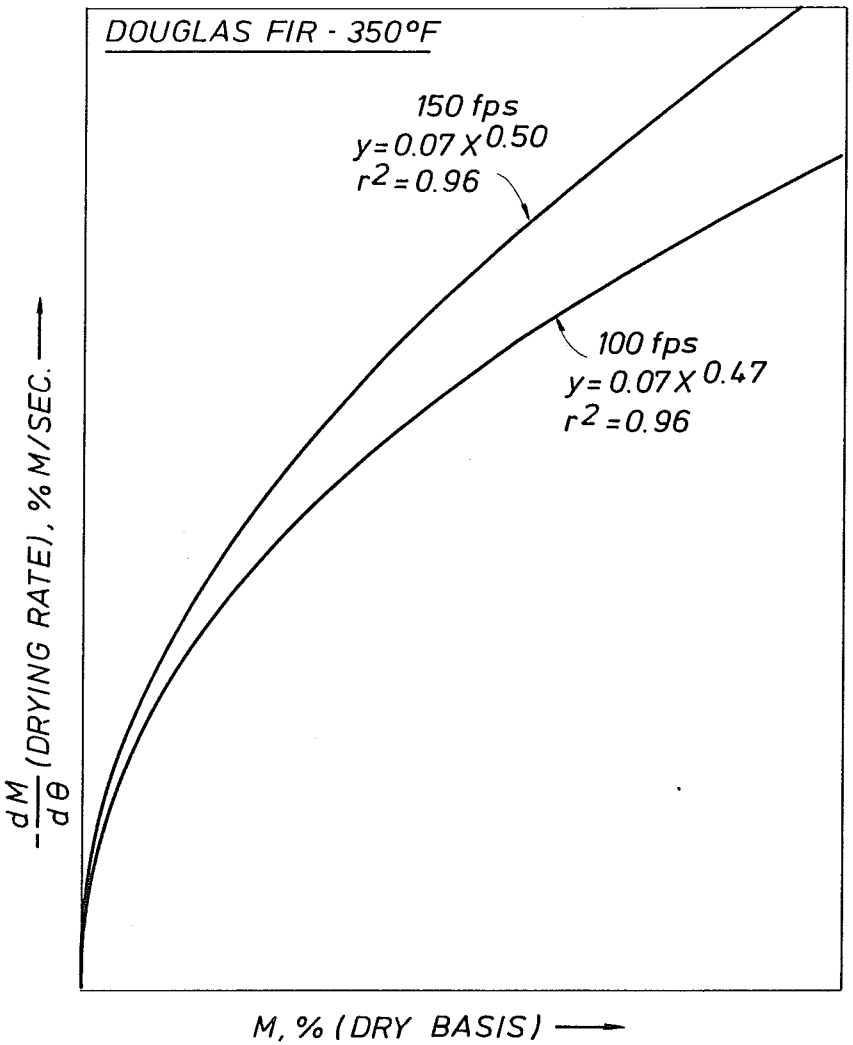
FIG. 5 is a graph of the relationship of moisture content, M, to the drying rate, ($dM/d\theta$) for Douglas Fir dried under two different conditions.

A study and transformation of published data, however, indicated that actual drying rate vs. moisture content curves (FIGS. 5 and 6) and $\Delta T$ vs. moisture content curves (FIG. 4) are of the form:

$$y = ax^b \tag{1}$$

FIGS. (5) and (6), for example, are transformations of data from South's paper for Douglas Fir and Southern Pine that follow equation (1) with remarkably high correlation thus confirming that thin veneer does not exhibit the classical drying rate curve characterized by two linear portions, one constant and the other falling. FIG. 8, a graph of drying rate vs moisture for 4/4 lumber, confirms this also for lumber.

In the above-identified copending application, which is incorporated herein by reference for all purposes, a mathematical model is derived for drying wood that included development of an intermediate relationship between the final moisture content $M_2$. The total drying time from time zero and the temperature drop across the product at t=final. At this intermediate point in the derivation, the model is primarily applicable to a batch dryer such as a lumber dry kiln. The original derivation was continued by substituting into the equation for drying time $\theta$, a distance term divided by time, $L/\theta$, to obtain dryer speed S, thereby presenting the equation in terms of dryer speed rather than drying time for use with continuous dryers such as veneer dryers.

The following is the derivation from my copending application, adapted to a batch type dryer.

The following table shows the results of subjecting Comstock's data to a curve fit using Equation (1) as the model.

| Equation Number | Equation | Correlation $r^2$ | Drying Conditions |
|---|---|---|---|
| 2 | $-\frac{dM}{d\theta} = 0.021\ M^{0.59}$ | 0.96 | 1/8" Douglas Fir Drying Temperature 700° F. Air Velocity - 5000 fpm |
| 3 | $-\frac{dM}{d\theta} = 0.04\ M^{0.47}$ | 0.96 | 3/16" Douglas Fir Drying Temperature 400° F. Air Velocity - 5000 fpm |
| 4 | $M = [0.032\ \Delta T_1]^{2.97}$ | 0.99 | 3/16" Douglas Fir Drying Temperature 400° F. Air Velocity - 5000 fpm |

Equation (3) is for the rate of drying, ($dM/d\theta$), vs moisture content, M curve. Equation (4) is for the moisture content, M, vs the difference between the temperature of the air and the wood, $\Delta T_1$.

Changing equation (3) to the general form for convenience gives:

$$-dM/d\theta = aM^b$$

Where:

a=0.04 b=0.47

Separation of variables and integration yields:

$$-\int_O^{M_1} dM/M^b = a\int_O^{\theta_1} d\theta \tag{5}$$

$$M_1 = -[(1-b)\,a\theta_1]^{1/(1-b)}$$

and similarly $$-\int_O^{M_2} dM/M^b = a\int_O^{\theta_2} d\theta \tag{6}$$

$$M_2 = -[(1-b)\,a\theta_2]^{1/(1-b)}$$

Subtracting: $M_2 - M_1$ and letting $1/(1-b)=q$ and $\theta_1 = O$ gives $$M_2 - M_1 = -[(a/q)^q\theta_2^q]$$

Solving for $M_1$ gives:

$$M_1 = M_2 + C_2\,\theta_2^q \tag{7}$$

Where:

$C_2 = [a/q]^q$ $M_2$=Veneer Moisture Content end of drying period, %

$M_1$=Veneer Moisture Content after being dried for time $\theta_1$, %

$\theta_2$=Elapsed drying time to reach final moisture content, $M_2$, Sec.

$\theta_1$=Elapsed drying time to reach intermediate moisture content, $M_1$, Sec.

Equation (7) gives the moisture content, $M_1$ at time $\theta_1$ in terms of the final drying time $\theta_2$ and the final moisture content $M_2$.

Equation (4) was derived from a fit of the moisture content, $M_1$, vs temperature difference between the drying medium and the veneer surface (FIG. 4).

Changing equation (4) to the general form for convenience gives:

$$M_1 = C_1 (dT_1)^p \quad (4A)$$

Two independent equations (4A) and (7) derived for the same species, veneer thickness, and drying conditions now exist in terms of $M_1$. By equating equations (4A) and (7), the very difficult to measure $M_1$ variable can be eliminated as follows:

$$M_1 = M_1 \quad (8)$$

Substituting $$M_2 + C_2\, \theta_2^q = C_1 (dt_1)^p \quad (8)$$

Solving for the drying time from time O gives $$\theta_2 = ]C_1/C_2(dT_1)^p - M_2/C_2]^{1/q} \quad (9)$$

Equation (9) relates the total drying time, $\theta_2$ to (1) the temperature difference between the wood surface and the drying medium; and (2) the final moisture content, $M_2$. $C_1$, $C_2$, p and q are constants for a given dryer and species of wood.

Several attempts were made to use the relationship of equation (9) to control a dryer, but measuring the temperature of the wood surface inside the dryer proved to be difficult and impractical. Infrared pyrometry was used with a certain amount of success; however, it was felt that it was not reliable enough due to the relatively small sample produced. Therefore, it was necessary to convert equation (9) to a more useful form. Modification of equation (9) was accomplished by use of an energy balance around a batch dryer (FIG. 7) with simplifying but acceptable assumptions.

Where:

$T_i$=Temp. ° F., heating medium prior to drying pass.
$T_o$=Temp. ° F., heating medium after drying pass.
G=Mass rate, drying medium (Air+Vapor), #/min.
C=Specific heat of drying medium, Btu/#° F.
$q_w$=Rate of heat accumulation by wood, Btu/min.
$q_e$=Rate of heat required for evaporating water.
$dT_2$=Temperature drop transversally or longitudinally in dryer.

Substituting into the balance equation and assuming that G and C do not vary appreciably especially during last half of drying time.

$$[T_i\, GC - T_o\, GC] - [q_e + q_w] = O \quad (10)$$

$$GC_p[T_i - T_o = q_w + q_e \quad (11)$$

Since $q_w + q_e$=Total heat added to dryer $q_t$, if shell and vent losses are neglected, therefore $$GC\,[T_i - T_o] = q_t \quad (12)$$

Now using the well known heat transfer equation:

$$q_t = UA_s \Delta T_1 \quad (13)$$

Where:

$q_t$=total heat transferred
U=overall heat transfer coefficient
$A_s$=heat transfer area of veneer—accounting for both sides of veneer
$dT_1$=heat transfer driving force for veneer; the temperature difference between veneer surface, $T_s$, and the hot air $T_i$, Substituting for $q_t$ in equation (12) above gives, $$GC\,[T_i - T_o] = UA_s\,[T_i - T_s] \quad (14)$$

Solving for $[T_i - T_s]$gives $$[T_i - T_s] = (GC)/UA_s\,[T_i - T_o] \quad (15)$$

$[T_i - T_s]$ of equation (15) is equal to $dT_1$ in equation (9) therefore by appropriate substitution of equations (15) and (9), the drying equation is obtained in terms of the temperature difference of the drying medium before and after contacting the product. This temperature difference, $dT_2$, is quite easily obtained in the following form.

$$\theta_2 = [C_1/C_2(GC/UA_s)\,(T_i - T_o)^P - M_2/C_2]^{1/q} \quad (16)$$

Letting $C_1/C_2\ (GC/UA)_s = R;\ [T_i - T_o] = dT_2$ and $1/q = s$ *then*

$$\theta_2 = [R(dT_2)^p - M_2/C_2]^s \quad (17)$$

where

R, $C_2$, p, and s are constants for a given dryer and product (species).

Equation (17) gives the drying time, $\theta_2$, for a batch dryer (FIG. 9) in terms of the final moisture content, $M_2$, and the differential temperature, ($dT_2$) of the drying medium before and after contacting the product to be dried.

It may be concluded that equation (17) is essentially the same as equation (16) of the original patent application. The only difference is that it includes a drying time term rather than a dryer speed term and thus in this form is applicable to a batch dryer such as a lumber dry kiln. After calibration to obtain constants and exponents, this equation provides a simple yet powerful batch drying model upon which a new batch control system is based.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A method of drying a product to a desired final moisture content in which the product being dried is contacted by a drying medium comprising the steps of placing the product in the dryer, measuring at a location in the dryer, a differential temperature, dT, that relates to the difference between the temperature of the drying medium and that of the product to determine at that time the remaining time the product should remain in the dryer to have the desired final moisture content, and controlling the equilibrium value of dT by varying either one of the components of dT and the time the product remains in the dryer to obtain the desired final moisture content in the product.

2. The method of claim 1 in which the drying medium is heated air and dT is the difference between the temperature of the air before it contacts the product and the temperature of the air after it has moved out of contact with the product.

3. A method of drying wood products to a desired final moisture content comprising the steps of placing the wood products in a dryer through which heated air is circulated, measuring the difference between the temperature of the air coming into the dryer ($T_1$) and the temperature of the air leaving the dryer, ($T_o$) and varying the temperature of the incoming air and the time the product remains in the dryer to obtain the desired final moisture content, continuously measuring the temperature difference between the inlet and outlet air, and continuously adjusting the temperature of the incoming air and the remaining time the product should remain in the dryer that is required to maintain the final moisture content of the dried product within an acceptable range in accordance with equation (17)

$$\theta_2=[R\,(dT_2)^p-M_2/C_2]^s,$$

where $M_2$=final moisture content $dT_2=(T_1-T_o)$, and $\theta_2$=total drying time for the product, and R, $C_2$, d and s are constants for a given dryer and product, and removing the product from the dryer when the time for obtaining the desired final moisture content has expired.

4. Apparatus for controlling a dryer of wood products to dry the wood products to a final moisture content that is within an acceptable range having means for moving heated air over the products, said apparatus comprising means for measuring the difference between the temperature of the air before the drying pass $T_1$ and the temperature of the air after the drying pass $T_o$, and means for varying the temperature and the volume of the incoming air and to maintain the final moisture content of the dried wood product within an acceptable range in accordance with the equation:

$$\theta_2=[R(dT_2)^p-M_2/C_2]^s,$$

where $M_2$=final moisture content $dT_2=T_1-T_o$, and $\theta_2$=total drying time for product to reach desired final moisture content, $M_2$, and R, $C_2$, p and s are constants for a given dryer and product.

5. A method of controlling a product dryer at a temperature above that of the product to raise the temperature of the product to dry the product to a desired final moisture content in which the product being dried is contacted by a drying medium comprising the steps of measuring the temperature of the drying medium before it contacts the product and the temperature of the drying medium after it contacts the product at a selected location in the dryer, calculating what the final moisture content of the product will be from the equation $$\theta_2=[R(dT_2)^p-M_2/C_2]^s,$$

where $M_2$=the final moisture content of the product $dT_2=(T_1-T_o)$ where $T_1$=temperature of drying medium prior to drying pass and $T_o$=temperature of drying medium after drying pass;

$\theta_2$=total drying time to final moisture content

R=a constant $C_2$=a constant and adjusting at least one of the time the product remains in the dryer and $dT_2$ to obtain the desired final moisture content of the product.

6. A method of drying a product to a desired final moisture content in which the product being dried is placed in a dryer where it is contacted by a drying medium comprising the steps of measuring at a location in the dryer a differential temperature, $dT_1$, that relates to the difference between the temperature of the drying medium and that of the product, calculating the time $\theta_2$ required to obtain the desired final moisture content $M_2$ of the product using the equation $$M_2 \approx dT_1-\theta_2$$

and controlling at least one of the value of $dT_1$ and $\theta_2$ to obtain the desired moisture content in the product.

7. The method of claim 6 in which the drying medium is heated air and dT is the difference between the temperature of the air before it contacts the product and the temperature of the air after it has moved out of contact with the product.

8. A method of drying products to a final moisture content within an acceptable range comprising the steps of placing the products in a dryer in which heated air is circulated, continuously measuring the difference $dT_2$ between the temperature of the air before it contacts the product $T_1$ and the temperature of the air after it has contacted the product, $T_o$, continuously calculating the time $\theta_2$ required to obtain the desired final moisture content $M_2$ using the equation $$M_2 \approx dt_2-\theta_2$$

and continuously adjusting the temperature of the incoming air as required for the final moisture content of the dried product to be within the acceptable range.

9. A method of drying products in a kiln dryer to a final moisture content within an acceptable range comprising the steps of keeping the drying time $\theta_2$ constant and controlling $T_1$ to a constant value and allowing $T_o$ to vary thereby making $dT_2$ an equilibrium value that is representative of the moisture content using the equation $$\theta_2=[R(dT_2)^p-M_2/C_2]^s,$$

where $T_1$=Temp. °F., of the heating medium prior to drying pass, $T_o$=Temp. °F., of the heating medium after drying pass, $dT_2$=Temperature drop of heating medium, $T_1-T_o$, $M_2$=Final moisture content, and R, $C_2$, p and s are constants for a given dryer and product.

10. A method of drying products in a kiln dryer to a final moisture content within an acceptable range comprising the steps of allowing the drying time $\theta_2$ to vary and controlling $T_1$ to a constant value and allowing $T_o$ to vary thereby making dT an equilibrium value which is representative of the moisture content using the equation $$\theta_2=[R(dT_2)^p-M_2/C_2]^s,$$

where $T_1$=Temp. °F., of the heating medium prior to drying pass, $T_o$=Temp. °F., of the heating medium after drying pass, $dT_2$=Temperature drop of heating medium, $T_1-T_o$, $M_2$=Final moisture content, and R, $C_2$, p and s are constants for a given dryer and product.

* * * * *